US011081070B2

(12) United States Patent
Calayir et al.

(10) Patent No.: US 11,081,070 B2
(45) Date of Patent: Aug. 3, 2021

(54) BACKLIGHT SYSTEMS AND METHODS FOR ELECTRONIC DEVICE DISPLAYS

(71) Applicant: Apple Inc., Cupertino, CA (US)

(72) Inventors: Vehbi Calayir, San Jose, CA (US); Johan L. Piper, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/521,324

(22) Filed: Jul. 24, 2019

(65) Prior Publication Data

US 2020/0090608 A1 Mar. 19, 2020

Related U.S. Application Data

(60) Provisional application No. 62/733,034, filed on Sep. 18, 2018.

(51) Int. Cl.
*G09G 3/36* (2006.01)
*H05B 45/10* (2020.01)

(52) U.S. Cl.
CPC ..... *G09G 3/3648* (2013.01); *G09G 3/3674* (2013.01); *H05B 45/10* (2020.01); *G09G 2320/0626* (2013.01)

(58) Field of Classification Search
CPC ..... G09G 3/3611; G09G 3/3618; G09G 2320/0247; G09G 3/36; G09G 3/3233; G09G 3/32; G09G 2310/0237; G09G 3/3433; G09G 2310/0235; G09G 3/3406; G09G 2310/0275; G06F 3/147
See application file for complete search history.

(56) References Cited

U.S. PATENT DOCUMENTS

| | | | | |
|---|---|---|---|---|
| 8,432,351 | B2 | 4/2013 | Pan et al. | |
| 2009/0001251 | A1* | 1/2009 | Ng | G01J 3/506 250/205 |
| 2009/0135108 | A1* | 5/2009 | Lindfors | G09G 3/3426 345/76 |
| 2010/0134406 | A1* | 6/2010 | Maruyama | G09G 3/3426 345/102 |
| 2010/0134521 | A1 | 6/2010 | Hente et al. | |
| 2012/0002133 | A1* | 1/2012 | Yamazaki | G09G 3/342 349/61 |
| 2012/0236049 | A1* | 9/2012 | Todorovich | G09G 3/3466 345/694 |

(Continued)

OTHER PUBLICATIONS

PCT/US2019/048638, "Notification of Transmittal of the International Search Report and the Written Opinion of the International Searching Authority, or the Declaration" dated Oct. 29, 2019, 19 pages.

*Primary Examiner* — Gerald Johnson
(74) *Attorney, Agent, or Firm* — Aikin & Gallant, LLP

(57) ABSTRACT

Aspects of the subject technology relate to control circuitry for light-emitting diodes (LEDs). The control circuitry may include an LED timing controller integrated circuit configured to receive data from host circuitry for an electronic device, an LED row driver integrated circuit, the LED row driver integrated circuit configured to connect a high voltage power rail to the light-emitting diodes via plurality of switches, and LED column driver integrated circuits each configured to adjust a current through at least one of the light-emitting diodes.

21 Claims, 18 Drawing Sheets

(56) References Cited

U.S. PATENT DOCUMENTS

| | | | | |
|---|---|---|---|---|
| 2012/0242236 | A1* | 9/2012 | Vaananen | G09G 3/3413 315/192 |
| 2014/0184666 | A1* | 7/2014 | Jun | G09G 3/3648 345/691 |
| 2015/0296580 | A1* | 10/2015 | Kim | G02F 1/133603 349/69 |
| 2016/0360144 | A1* | 12/2016 | Williams | H05B 45/00 |
| 2017/0084248 | A1* | 3/2017 | Shi | G09G 5/10 |
| 2018/0122334 | A1* | 5/2018 | Coppin | G09G 5/397 |
| 2018/0190188 | A1* | 7/2018 | Ng | G09G 3/3216 |

* cited by examiner

BACKLIGHT SYSTEMS AND METHODS FOR ELECTRONIC DEVICE DISPLAYS

RELATED APPLICATIONS

This application claims the benefit of priority of U.S. Provisional Application No. 62/733,034 filed Sep. 18, 2018 which is incorporated herein by reference.

TECHNICAL FIELD

The present description relates generally to electronic devices with displays, and more particularly, but not exclusively, to backlight systems and methods for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

The backlight unit commonly includes one or more light-emitting diodes (LEDs) that generate light that exits the backlight toward the liquid crystal display unit. The liquid crystal display pixels are individually operable to control passage of light from the backlight unit through that pixel to display content such as text, images, video, or other content on the display.

SUMMARY OF THE DESCRIPTION

In accordance with various aspects of the subject disclosure, an electronic device is provided that includes a display with a backlight unit. The backlight unit includes a backlight substrate, an array of light-emitting diodes arranged in rows and columns on the backlight substrate, a backlight timing controller integrated circuit on the backlight substrate and configured to receive backlight data from host circuitry for the electronic device via a high speed link, a backlight row driver integrated circuit on the backlight substrate, where the backlight row driver integrated circuit configured to connect a high voltage power rail to the light-emitting diodes via plurality of switches, and a plurality of backlight column driver integrated circuits on the backlight substrate, each column driver integrated circuit configured to control a current through at least one of the light-emitting diodes.

In accordance with other aspects of the subject disclosure, an electronic device is provided that includes a display with a backlight unit. The backlight unit includes an array of light-emitting diodes arranged in rows and columns, the rows arranged in groups of adjacent rows, a backlight row driver, the backlight row driver having a plurality of switches, each coupled to at least one row in each of the groups of adjacent rows, and a plurality of backlight column drivers, each backlight column driver coupled to one of the groups of adjacent rows.

In accordance with other aspects of the subject disclosure, an electronic device is provided that includes a display with a backlight unit. The backlight unit includes an array of light-emitting diodes arranged in rows and columns, the rows arranged in groups of adjacent rows, a backlight row driver, the backlight row driver having a plurality of switches, each coupled to at least one row in each of the groups of adjacent rows, a plurality of backlight column drivers, each backlight column driver coupled to a subset of the columns in each of the groups of adjacent rows In accordance with other aspects of the subject disclosure, an electronic device is provided that includes a display having a liquid crystal display unit having an array of pixels configured to be operated by liquid crystal display control circuitry at an LCD scan rate, and a backlight unit. The backlight unit includes an array of light-emitting diodes arranged in rows and columns and each operable to illuminate a corresponding portion of the array of pixels. The backlight unit also includes backlight control circuitry configured to concurrently operate multiple rows of the array of light-emitting diodes, each of the multiple rows disposed in a different one of multiple corresponding groups of mutually adjacent rows. The backlight control circuitry is further configured to synchronize operation of the rows of the array of light-emitting diodes with operation of the rows of the array of pixels of the liquid crystal display unit by performing at least one of: (i) maintaining a scan rate of the array of light-emitting diodes above a threshold that is based on the LCD scan rate and a number of the different groups, (ii) concurrently operating the multiple rows by concurrently operating multiple sub-groups of adjacent rows, each sub-group disposed in a different one of the multiple corresponding groups, or (iii) operating the rows within each of the multiple corresponding groups in a non-sequential order.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
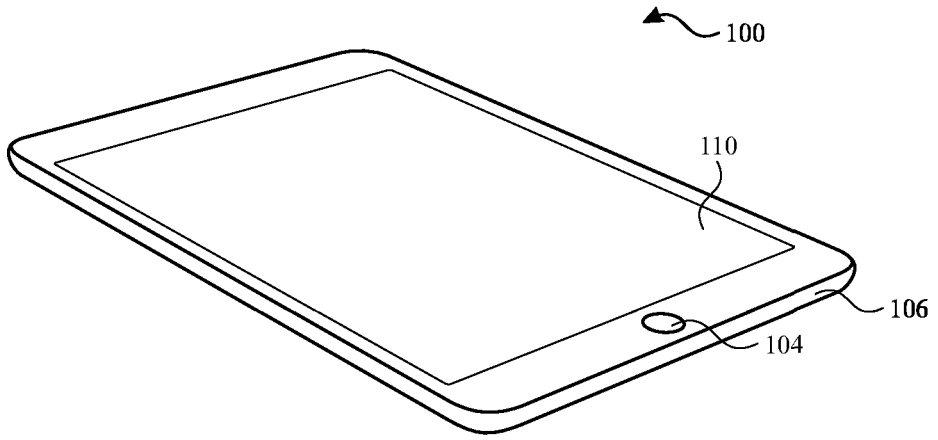
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images.

Each display pixel may include a layer of liquid crystals disposed between a pair of electrodes operable to control the orientation of the liquid crystals. Controlling the orientation of the liquid crystals controls the polarization of backlight from a backlight unit of the display. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

Although examples discussed herein describe LEDs included in display backlights, it should be appreciated that the LED control circuitry and methods described herein can be applied to LEDs implemented in other devices or portions of a device (e.g., in a backlit keyboard or a flash device).

Backlight (BL) control circuitry for the backlight unit includes backlight row drivers and backlight column drivers that control one or more light-emitting diodes (LEDs) such as an array of LEDs arranged in LED rows and LED columns. The backlight control circuitry also includes a backlight controller (BCON) communicatively coupled to the backlight row drivers and the backlight column drivers. The BCON and the BL row drivers and BL column drivers can be implemented as separate integrated circuits or can be integrated into one common unit or in any of various integrated combinations. Based on control signals from the BCON, the backlight row drivers and backlight column drivers can operate various portions of the array of LEDs to provide a desired amount of backlight for the LCD pixels, to generate desired display content in various zones of the display. In accordance with various aspects of the disclosure, rows of backlight LEDs can be operated in groups of adjacent rows and in synchronization with the LCD pixels.

An illustrative electronic device having light-emitting diodes is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations. An LED backlight array may also be provided for the keyboard and/or other illuminated portions of device 100.

In some implementations, electronic device 100 may be provided in the form of a computer integrated into a computer monitor. Display 110 may be mounted on a front surface of housing 106 and a stand may be provided to support housing (e.g., on a desktop).

Figure 2:
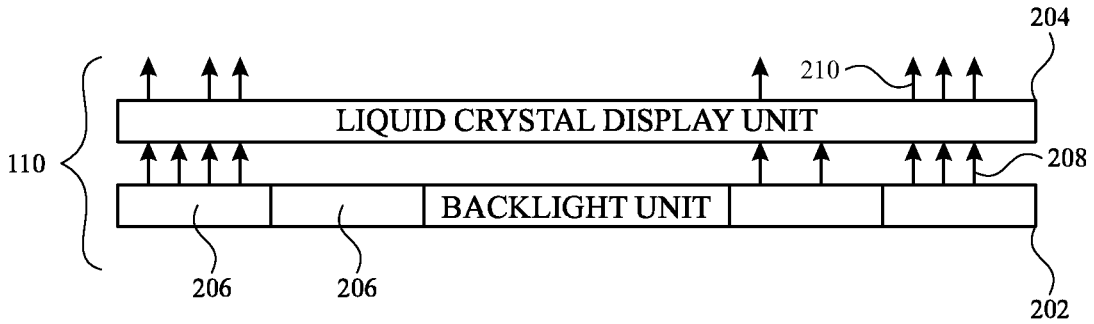
FIG. 2 illustrates a block diagram of a side view of an electronic device display having a backlight unit in accordance with various aspects of the subject technology.

FIG. 2 is a schematic diagram of display 110 in which the display is provided with a liquid crystal display unit 204 and a backlight unit 202. As shown in FIG. 2, backlight unit 202 generates backlight 208 and emits backlight 208 in the direction of liquid crystal display unit 204. Liquid crystal display unit 204 selectively allows some or all of the backlight 208 to pass through the liquid crystal display pixels therein to generate display light 210 visible to a user. Backlight unit 202 includes one or more subsections 206.

In some implementations, subsections 206 may be elongated subsections that extend horizontally or vertically across some or all of display 110 (e.g., in an edge-lit configuration for backlight unit 202). In other implementations, subsections 206 may be square or other rectilinear subsections (e.g., subarrays of a two-dimensional LED array backlight or a two-dimensional array of LED strings). Accordingly, subsections 206 may be defined by one or more strings and/or arrays of LEDs disposed in that subsection. Subsections 206 may define operable zones of BLU 202 that can be controlled individually for local dimming of backlight 208.

Although backlight unit 202 is shown implemented with a liquid crystal display unit, it should be appreciated that a backlight unit such as backlight unit 202 may be implemented in a backlit keyboard, or to illuminate a flash device or otherwise provide illumination for an electronic device.

Figure 3:
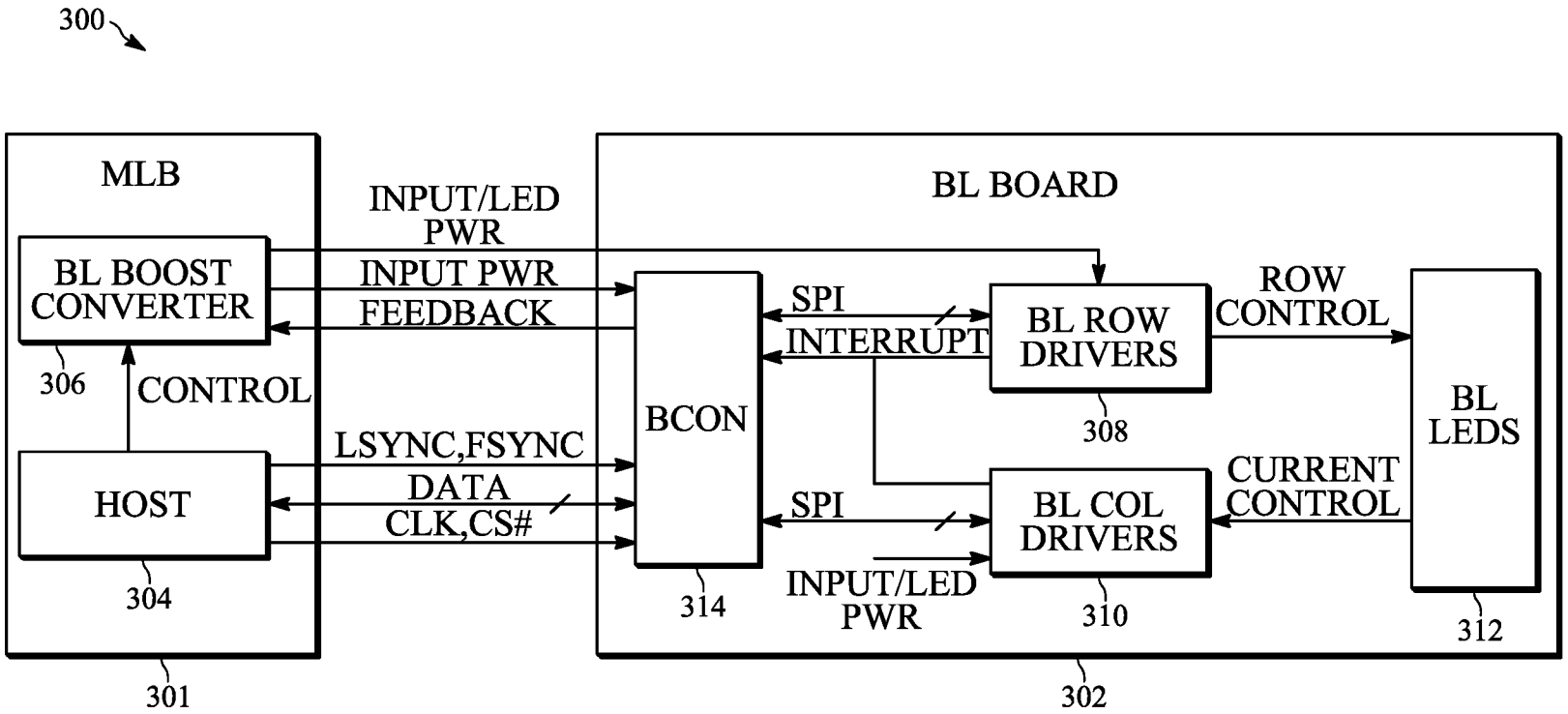
FIG. 3 illustrates a schematic diagram of light-emitting diode (LED) control circuitry in accordance with various aspects of the subject technology.

FIG. 3 shows a schematic diagram of exemplary circuitry for electronic device 100 including host circuitry and LED circuitry such as backlight circuitry for display 110. For example, device circuitry 300 of FIG. 3 may include a backlight board 302 that can be implemented in backlight unit 202 or other LED lighting devices.

In the example of FIG. 3, device circuitry 300 includes a main logic board (MLB) 301 having host circuitry 304 and includes backlight circuitry that includes backlight controller (BCON) integrated circuit 314, backlight row driver integrated circuits 308, backlight column driver integrated circuits 310, and backlight LEDs 312. As shown, LEDs 312 are operated by BL row driver ICs 308 and BL column driver ICs 310 based on commands/signals from backlight controller IC 314. In this example, backlight controller IC 314, backlight row driver IC 308, backlight column driver IC 310, and backlight LEDs 312 are implemented on a common backlight board 302. In this example, BCON 314, BL row driver ICs 308 and BL column driver ICs 310 are implemented as separate integrated circuits. However, it should be appreciated that BCON 314, BL row driver ICs 308 and BL column driver ICs 310 can be integrated into one common unit or in any of various integrated combinations. The backlight controller 314, backlight row drivers 308, and backlight column drivers 310 can communicate via a communication protocol (e.g., synchronous serial communication (SPI)). The backlight row drivers 308 and backlight column drivers 310 can send interrupt signals to the backlight controller 314 for specific interrupt conditions. Backlight controller IC 314 receives control signals from host circuitry 304.

In the example of FIG. 3, a power supply for backlight unit 202 is provided on MLB 301. In this example, the power supply for backlight unit 202 is implemented as a boost converter 306 mounted on the same MLB as host circuitry 304. However, it should be appreciated that the power supply for backlight unit 202 may be any type of DC/DC converter. The boost converter 306 provides input power to the backlight controller 314 and also provides input/LED power to the backlight row drivers 308 and backlight column drivers 310. The arrangement shown in FIG. 3, in which LEDs 312 are operated by BL row driver ICs 308 and BL column driver ICs 310 based on commands from backlight controller IC 314, provides various advantages over conventional backlight arrangements including that a single high-speed link is provided between host circuitry 304 and the backlight control circuitry, analog and digital chips are separated and implemented in different processing nodes, frame memory for the backlight LEDs 312 is provided in a single chip (e.g., BCON 314) for self-refresh of the backlight unit, data transfer bandwidth usage is reduced via dedicated data links for each of BL row driver ICs 308 and BL column driver ICs 310 from BCON 314, and board-level routing for backlight board 302 is improved as discussed in further detail hereinafter.

Host circuitry 304 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in host circuitry 304. Processing circuitry in host circuitry 304 may be used in controlling the operation of device 100. Processing circuitry in host circuitry 304 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, host circuitry 304 may be used to run software for device 100, such as internet browsing applications, email applications, media playback applications, operating system functions, etc.

As shown in FIG. 3, backlight timing controller integrated circuit 314 on the backlight substrate 302 receives backlight data from host circuitry 304 for the electronic device via a high speed link. Backlight row driver integrated circuits 308 on the backlight substrate 302 connect a high voltage power rail to the LEDs 312 via a plurality of switches (e.g., high-side switches). Backlight column driver integrated circuits 310 are operable by BCON IC 314 to adjust the amount of current through each LED or string of LEDs 312 and provide individual PWM dimming for each LED or string of LEDs 312. The host circuitry 304 and backlight timing controller integrated circuit 314 can communicate via multiple high speed data links (e.g., 2).

Various advantageous arrangements for the driving operations and the layout of electrical connections (e.g., traces on BL board 302) between row driver ICs 308, column driver ICs 310, and LEDs 312 are described in further detail hereinafter.

In one suitable example, rows of LEDs 312 are operated in groups by row driver ICs 308 and column driver ICs 310. The grouping or segmentation of the array of LEDs 312 can increase the duty cycle and reduce peak currents for operation of the LED array.

Figure 4:
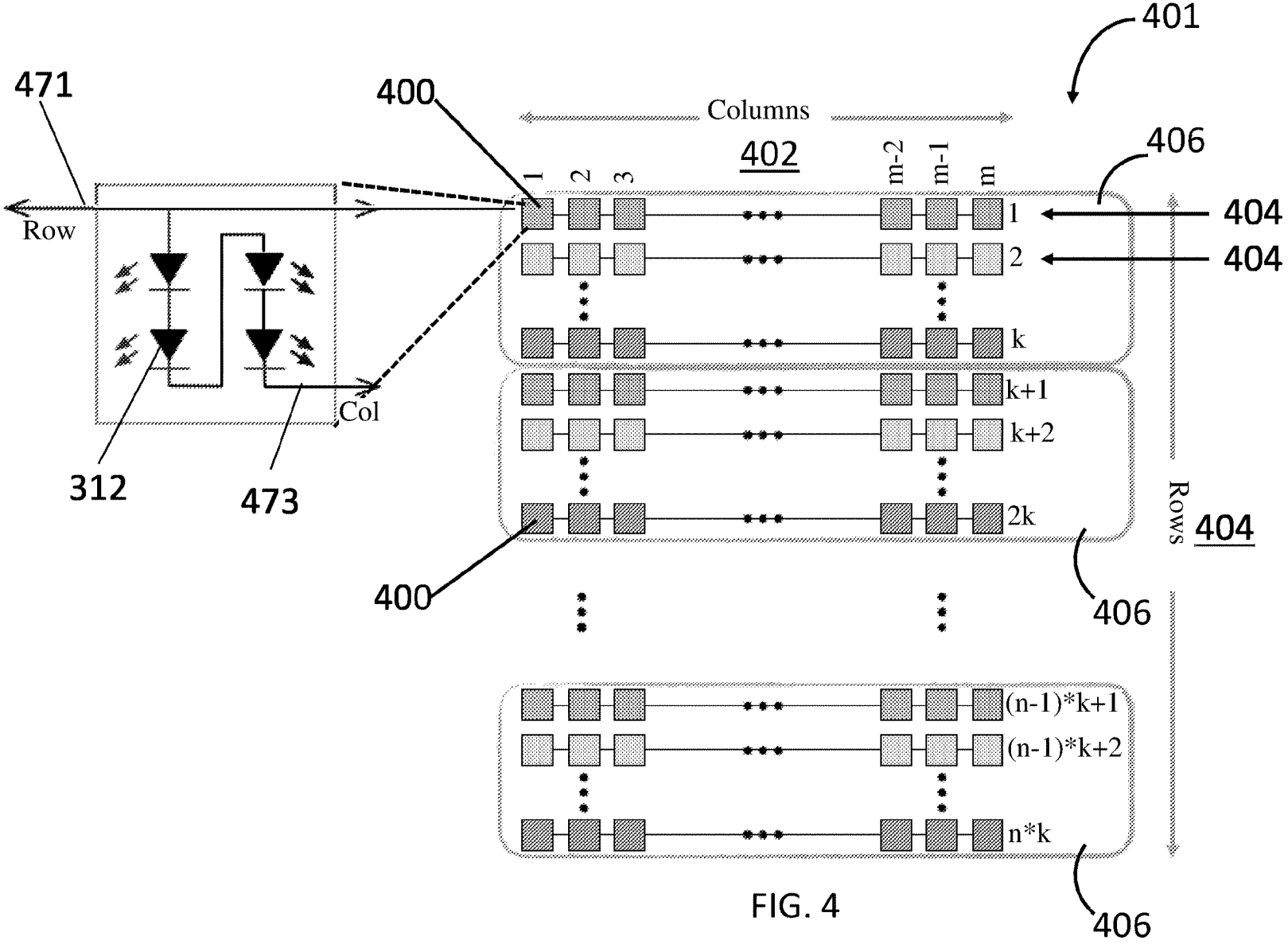
FIG. 4 illustrates group-based operation of rows of LEDs of a display backlight in accordance with various aspects of the subject technology.

FIG. 4 illustrates how groups 406 of rows 404 of LEDs 400 (e.g., each representing one or more of LEDs 312) can be operated in a group-based row operation. In the example of FIG. 4, LED array 401 includes LEDs 400 arranged in rows 404 and columns 402. LEDs 400 may be individual LEDs or may be strings of series-coupled LEDs (e.g., with four or more individual LEDs 312 coupled in series between a row line 471 and a column line 473 coupled to a current controller of one of column driver ICs 310). As indicated, rows 404 may be operated in groups 406 such that one or more rows 404 in each group 406 is operated at the same time as the corresponding row(s) in the other groups 406. As indicated in the figure, array 401 may include a number m columns, a number n groups 406 each having a number k rows, and a total of n*k rows. As indicated in the figure, the first row in each group 406 is operated at the same time, the second row in each group 406 is operated at the same time, and so on until the k-th row in each group is operated at the same time.

Figure 5:
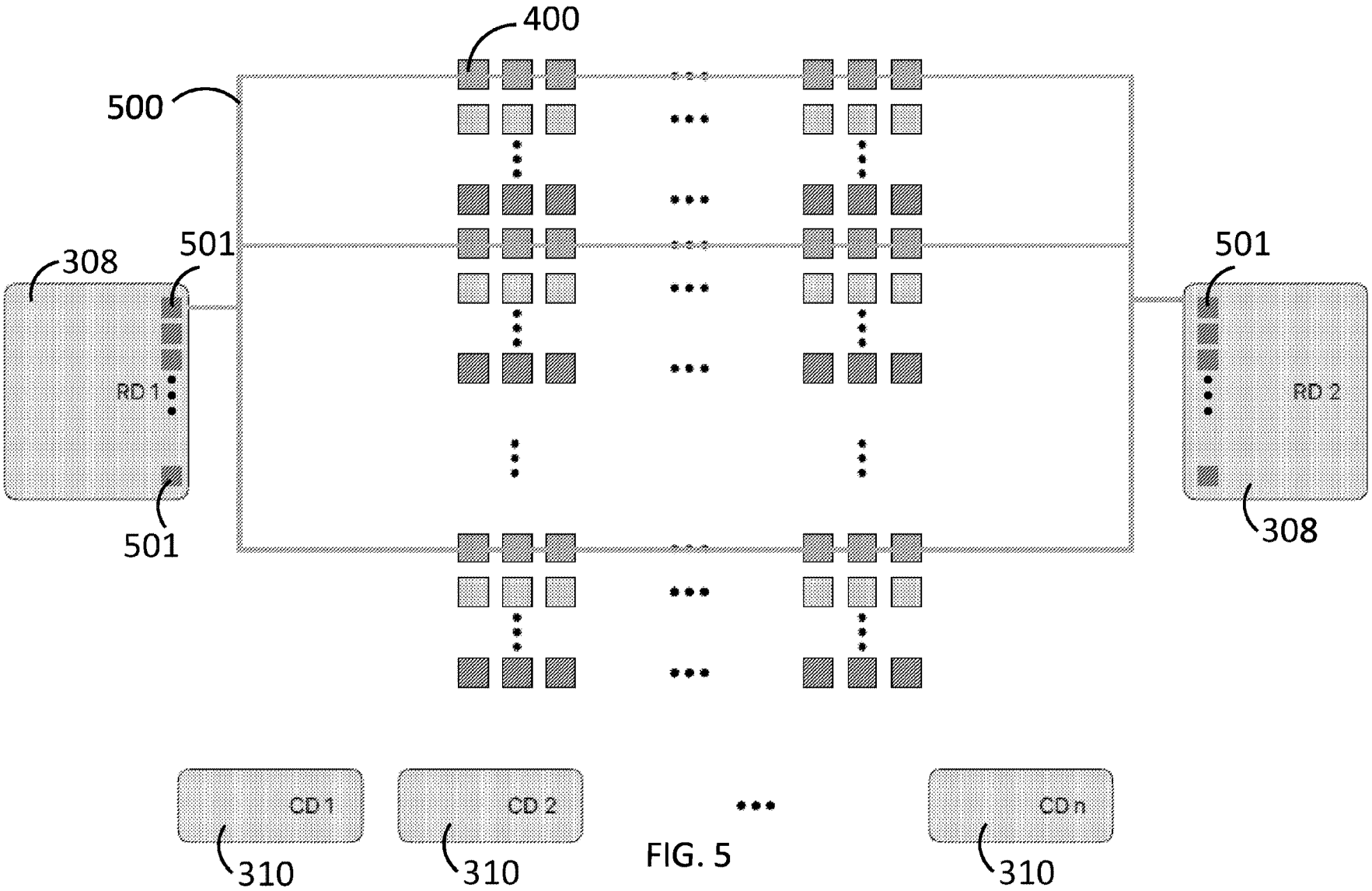
FIGS. 5-8 illustrate an exemplary implementation of row driver electrical routing for group-based operation of rows of LEDs of a display backlight in accordance with various aspects of the subject technology.

An exemplary layout of traces for coupling the first row 404 of each group 406 to a common switch (e.g., a common high-side switch) in a row driver IC 308 is shown in FIG. 5. In the example of FIG. 5, the first row 404 in all groups 406 is shorted together by traces 500 (e.g., an implementation of a row line 471 of FIG. 4) and coupled to a common switch 501 in row driver IC 308. Each row driver IC 308 may include a number of switches equal to or greater than the number of rows in groups 406. In the example of FIG. 5, two row driver ICs 308, one on each side of array 401, are provided to drive array 401 from both sides. However, it should be appreciated that single-side driving of array 401 with a single row driver IC 308 can also be provided.

Figure 6:
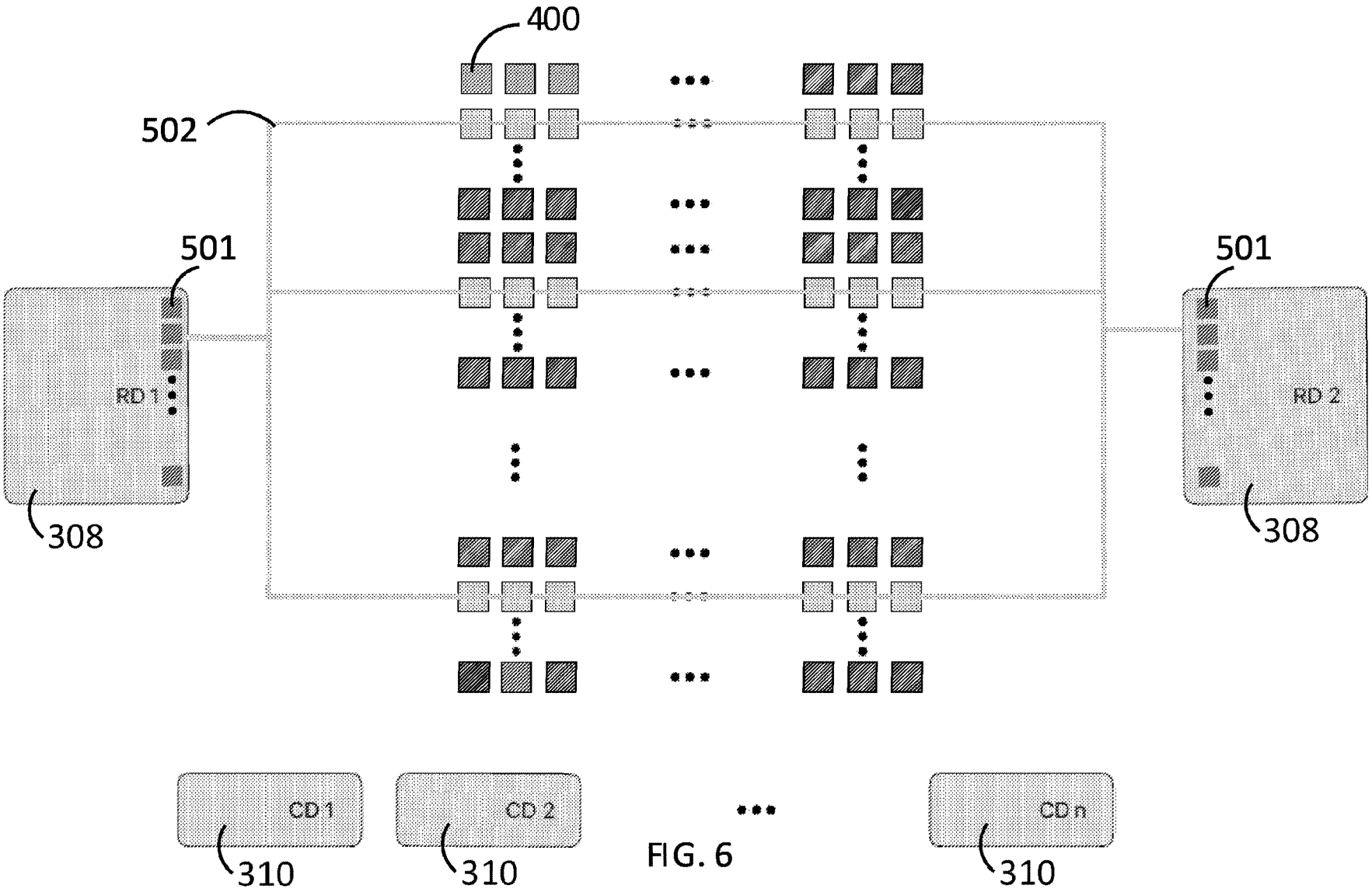
Figure 7:
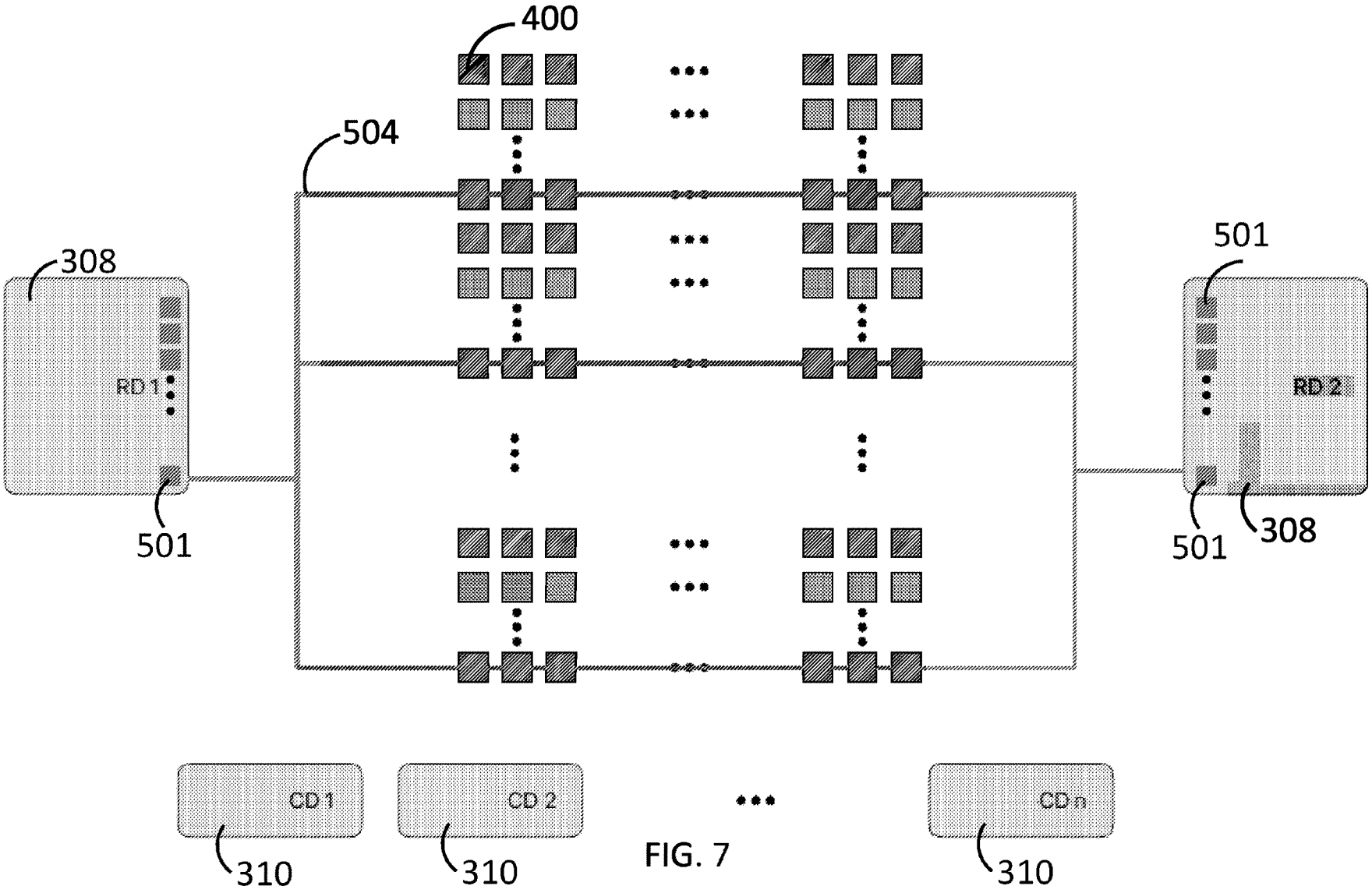
Figure 8:
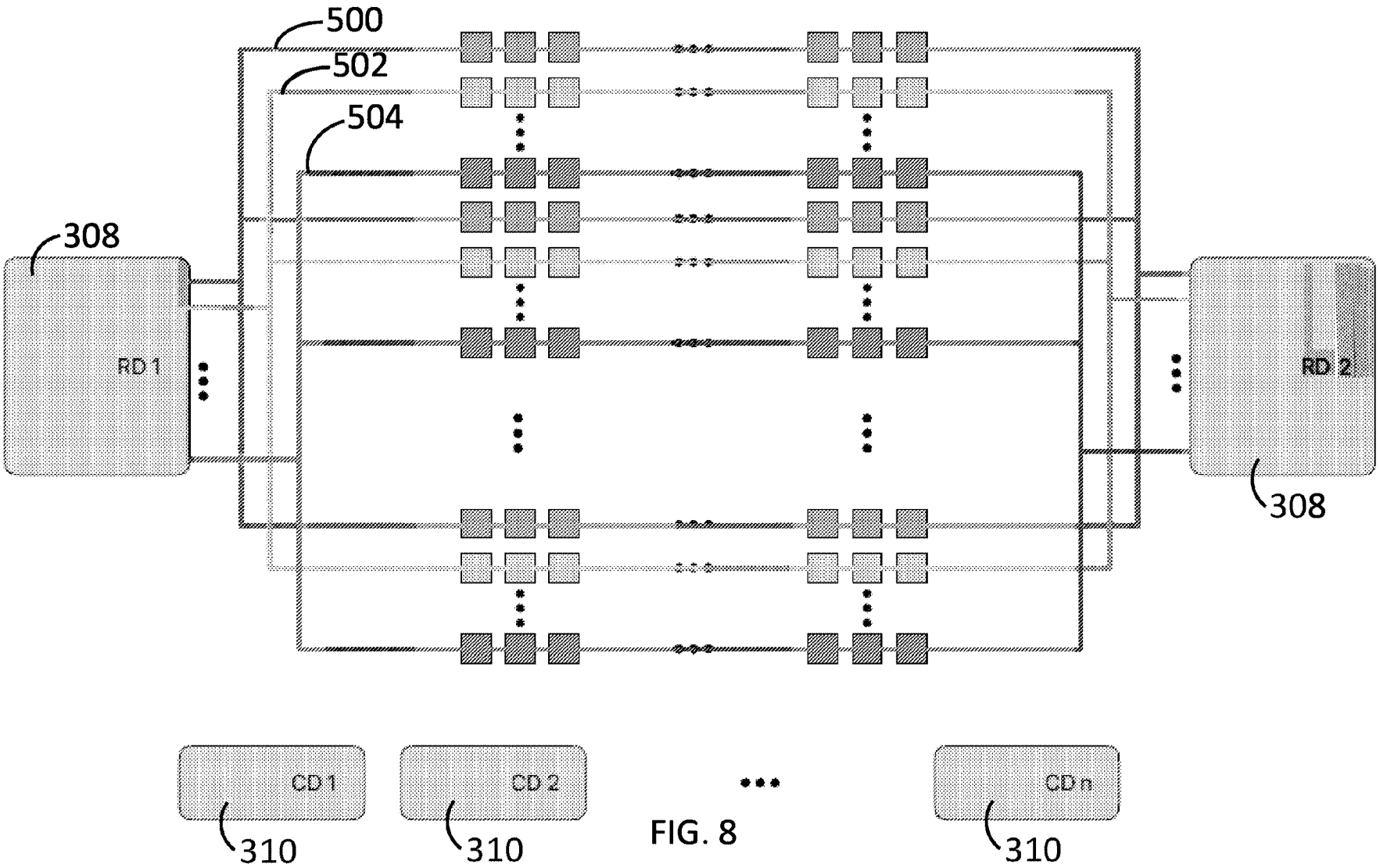

FIG. 6 shows how the second row 404 in all groups 406 is shorted together by traces 502 and coupled to a common switch 501 in row driver IC 308. FIG. 7 shows how the k-th row 404 in all groups 406 is shorted together by traces 504 and coupled to a common switch 501 in row driver IC 308. FIG. 8 shows all of traces 500, 502, and 504 of FIGS. 5, 6, and 7.

Figure 9:
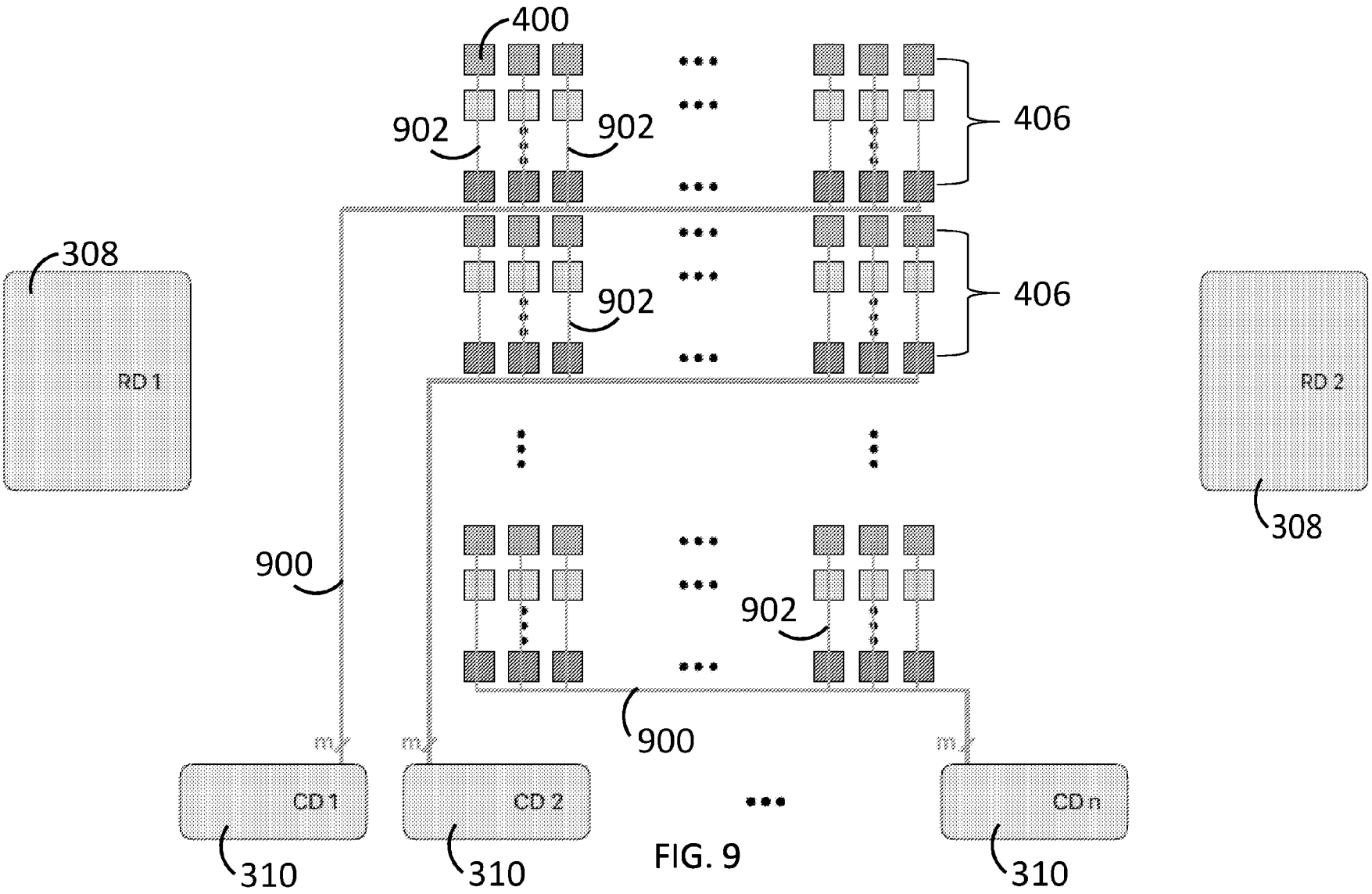
FIG. 9 illustrates an exemplary implementation of column driver electrical routing for group-based operation of rows of LEDs of a display backlight in accordance with various aspects of the subject technology.
Figure 10:
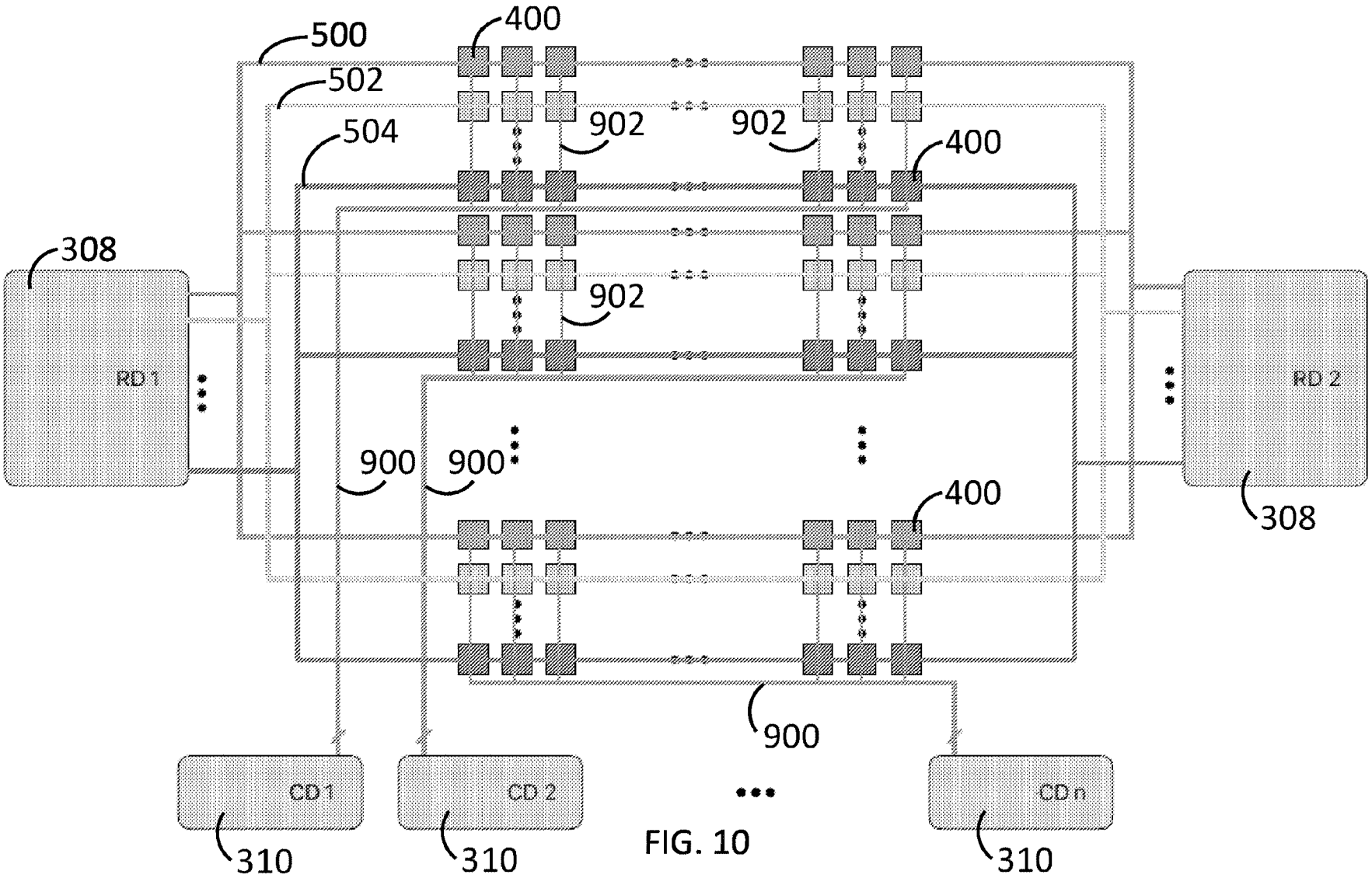
FIG. 10 illustrates the combined row driver electrical routing and column driver electrical routing of FIGS. 5-9 in accordance with various aspects of the subject technology.

FIG. 9 illustrates an exemplary layout of column driver traces for group-based operation of LEDs 400. In the example of FIG. 9, each group 406 is operated by a corresponding column driver IC 310 having a number of channels equal to the number of columns 402. As indicated in the figure, m traces 900 may run between each column driver IC 310 and m column lines 902 (e.g., implementations of a column lines 473 of FIG. 4). In this example, the LEDs 400 (or strings of LEDs) in the same column 402 within one group 406 are shorted together by a column line 902 and connected to one channel of the corresponding CD IC 310. FIG. 10 shows all of traces 500, 502, and 504 of FIGS. 5, 6, and 7 and traces 900 and column lines 902 of FIG. 9.

However, it should be appreciated that the column driver layout described in connection with FIGS. 9 and 10 is merely illustrative and other arrangements are contemplated. For example, in one suitable arrangement, a column intermixing layout is provided in which column driver ICs 310 are programmed to run as a number of smaller drivers in parallel.

Figure 11:
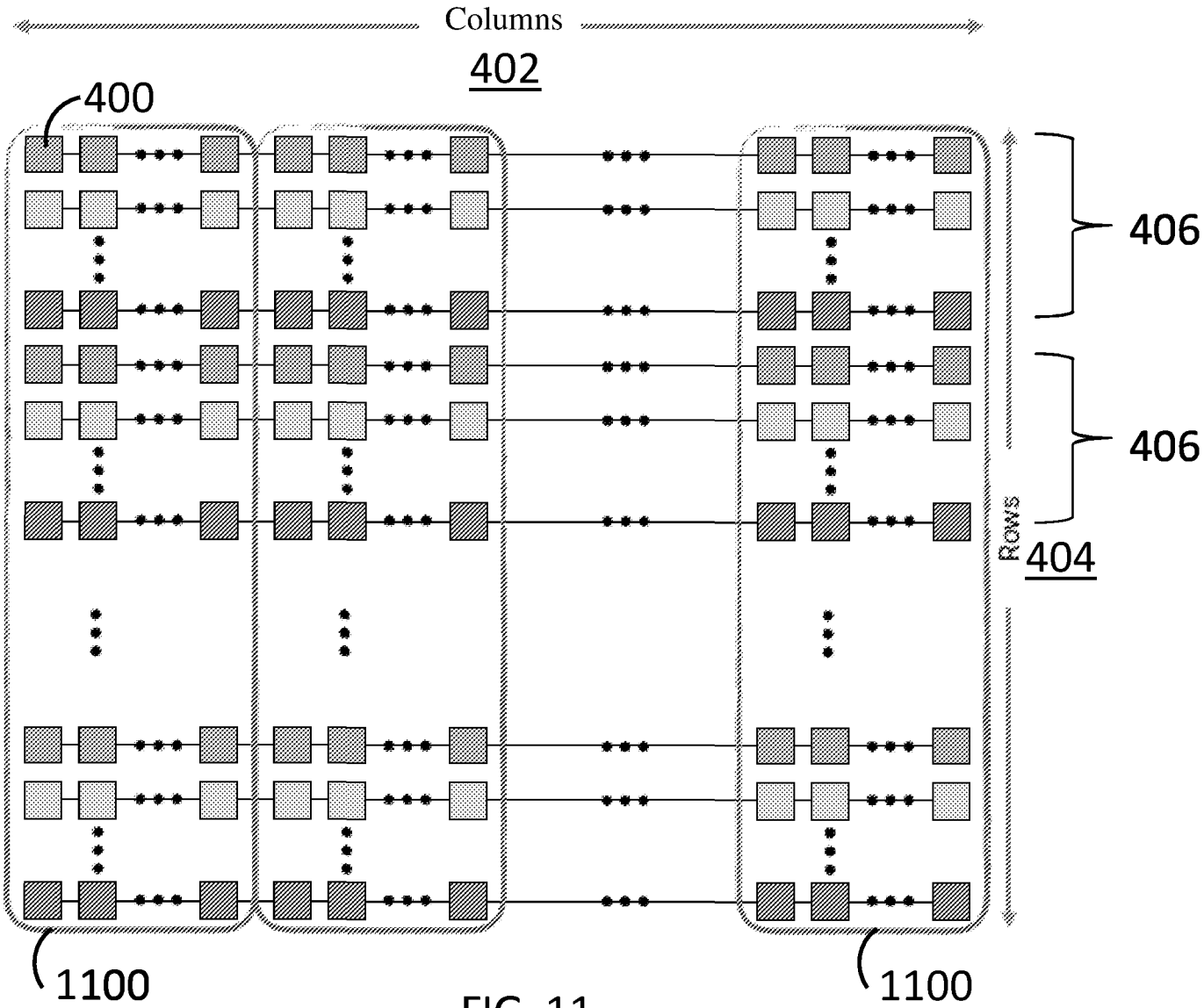
FIG. 11 illustrates a column-intermixed group-based operation of rows of LEDs of a display backlight in accordance with various aspects of the subject technology.
Figure 12:
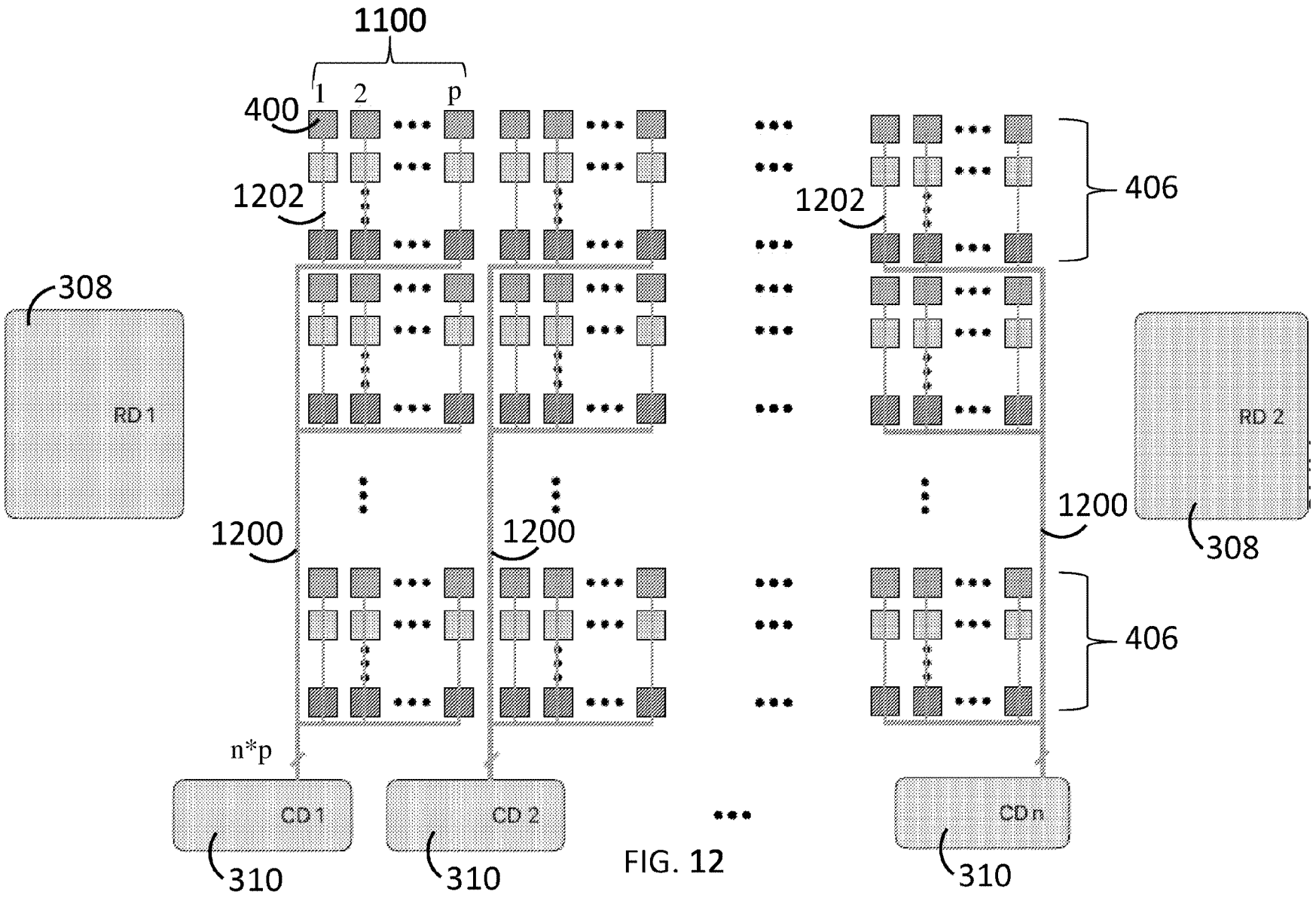
FIG. 12 illustrates an exemplary implementation of column driver electrical routing for column-intermixed group-based operation of rows of LEDs of a display backlight in accordance with various aspects of the subject technology.

FIG. 11 illustrates how, in a column-intermixing layout, groups (subsets) 1100 of p columns, each spanning a portion of a group 406 of rows 404, can be operated by a common column driver integrated circuit 310. FIG. 12 illustrates an exemplary layout of column driver traces for a column-intermixed group-based operation of LEDs 312. As shown in FIG. 12 a number n*p traces 1200, where n is the number of groups 406 and p is the number of columns in each subset 1100, run between each column driver IC 310 and p column lines 1202 (e.g., implementations of a column lines 473 of FIG. 4) in each of n groups 406. In this example, the LEDs 400 (or strings of LEDs) in the same column 402 within one group 406 are shorted together by a column line 1202 and connected to one channel of the corresponding CD IC 310.

The arrangement described above in connection with FIGS. 11 and 12 may reduce trace resistances across the rows and, hence, reduce the voltage drop and/or power consumption across board 302. This arrangement may also enable display panels with larger arrays of LEDs 312 with a reduced number of column drivers and no impact to the row driver connections (e.g., as described connection with FIGS. 5-8). For example, in the arrangement of FIG. 12, a backlight array with 75 columns of LEDs can be operated with five CD ICs 310 instead of, for example, eight CD ICs 310 in the arrangement of FIGS. 9 and 10.

Figure 13:
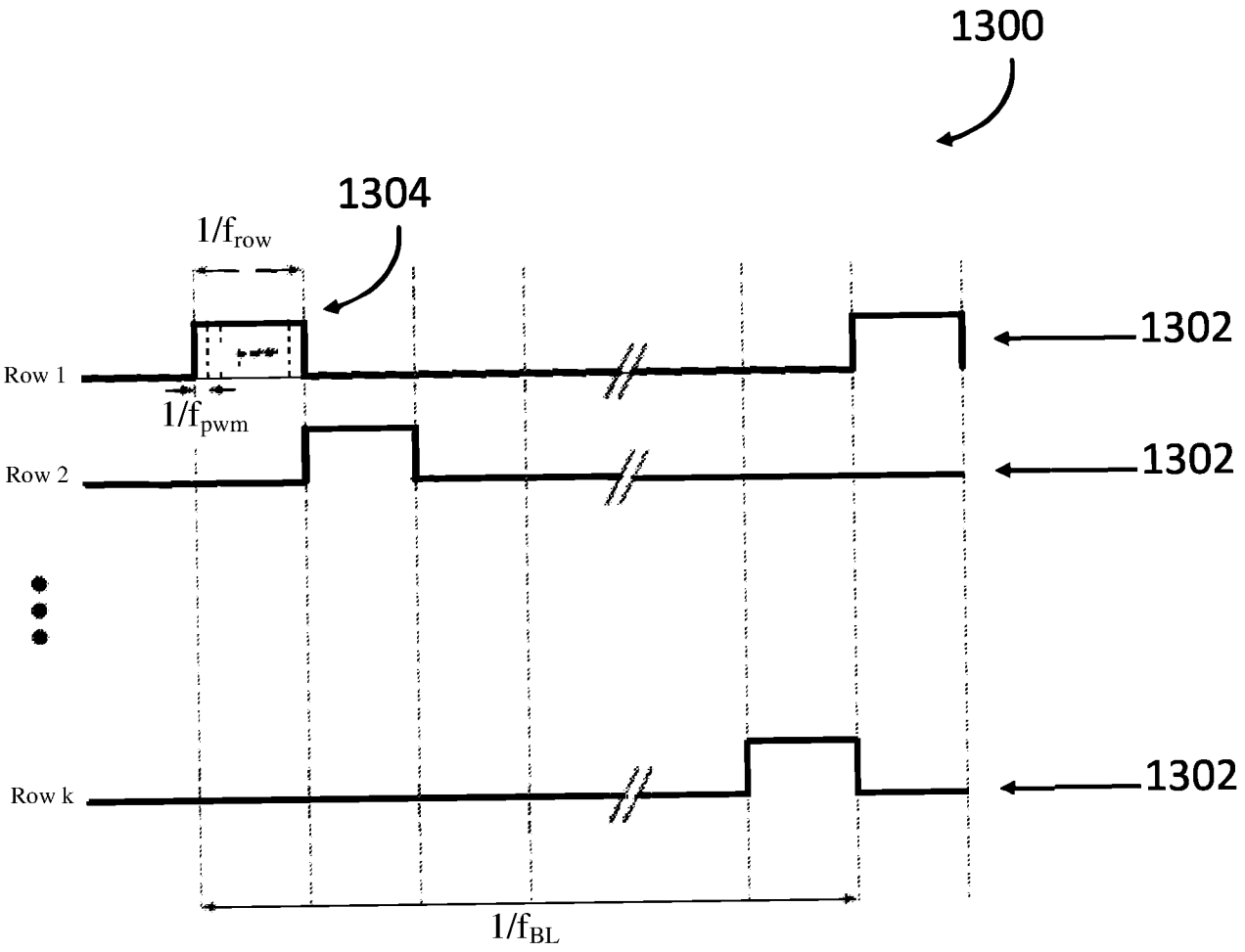
FIG. 13 illustrates a timing diagram for operation of rows of LEDs of a display backlight in accordance with various aspects of the subject technology.

BCON 314 may cooperate with row driver ICs 308 and column driver ICs 310 arranged as described herein to operate rows 404 and columns 402 of LEDs 312. FIG. 13 is a timing diagram 1300 illustrating a sequential operation of k rows in each group 406. In the example of FIG. 13, signal 1302 for each row includes an on pulse 1304 for that row, that sequentially follows the previous (adjacent) row. In FIG. 13, the time corresponding to the operation of each row ($1/f_{row}$), the time corresponding to a pulse width modulation (PWM) cycle for the LEDs in that row ($1/f_{pwm}$), and the time corresponding to a backlight scan ($1/f_{BL}$) are indicated. However, it should be appreciated that BL column drivers 310 can provide PWM dimming of the LEDs and/or pulse-amplitude-modulation dimming of the LEDs.

Figure 14:
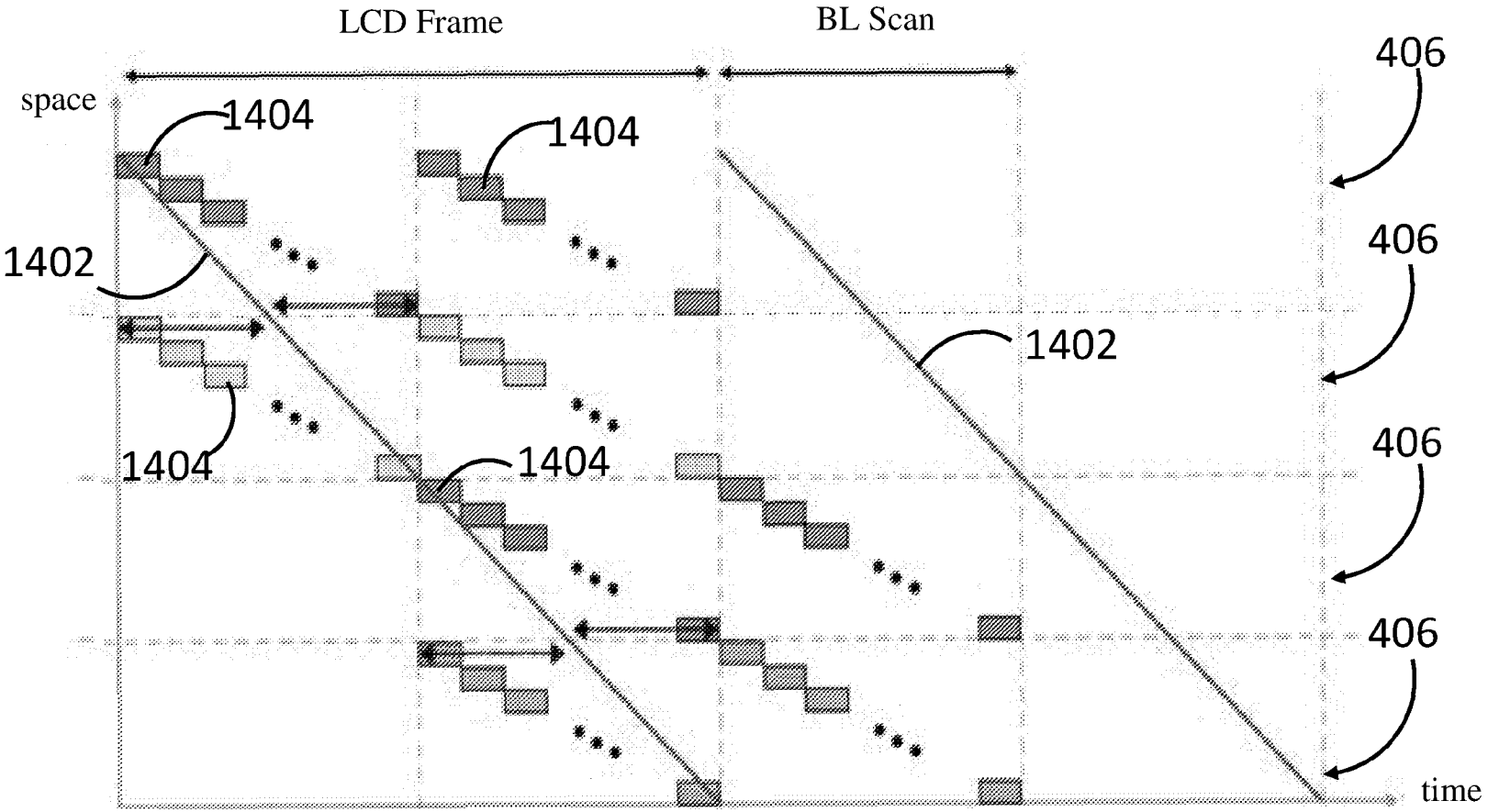
FIG. 14 illustrates an LCD synchronization error that can occur during operation of rows of LEDs of a display backlight in accordance with various aspects of the subject technology.

However, as indicated in FIG. 14, a sequential operation of backlight rows 404 in each of several groups 406 that are operated concurrently, can result in a synchronization error with the operation of LCD unit 204. In particular, FIG. 14 shows the progression of an LCD scan 1402 (e.g., sequential operation of rows of LCD pixels in LCD unit 204) overlaid on the backlight row operation indicators 1404 in each of several groups (regions) 406. Synchronized operation would appear with all backlight row operation indicators 1404 coinciding with an LCD scan 1402. However, as shown, if care is not taken the LCD unit and backlight unit can be out of sync.

In accordance with various aspects of the subject disclosure, synchronization of LCD unit 204 and backlight unit 202 can be achieved by (i) maintaining a scan rate of the array of LEDs 312 above a threshold that is based on the rate of LCD scan 1402 and a number of the different groups, (ii) concurrently operating multiple rows by concurrently operating multiple sub-groups of adjacent rows, each sub-group disposed in a different one of multiple corresponding groups, and/or (iii) operating the rows within each of multiple corresponding groups in a non-sequential order.

Figure 15:
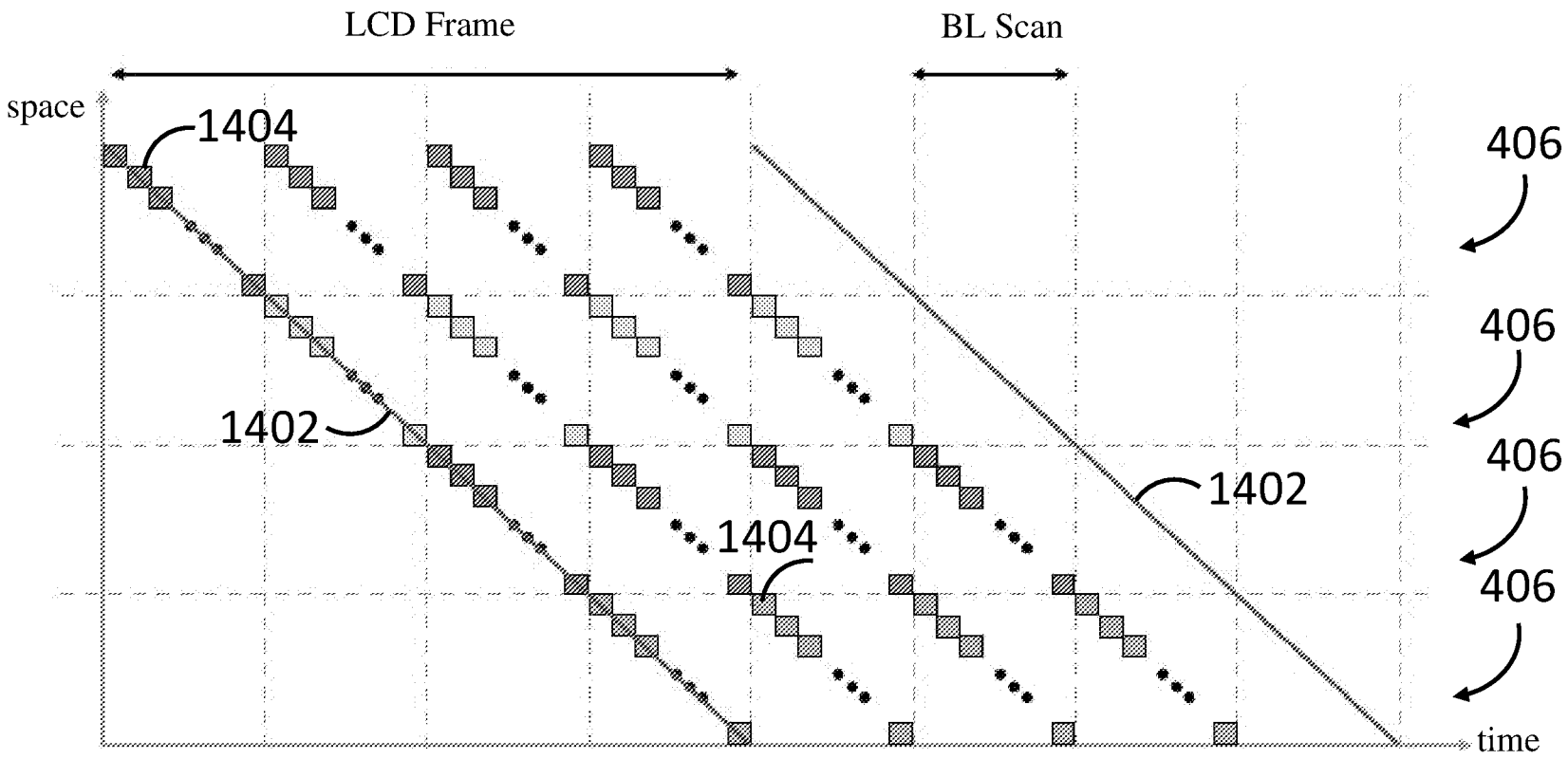
FIG. 15 illustrates an LCD synchronized operation of rows of LEDs of a display backlight based on a minimum backlight scan rate in accordance with various aspects of the subject technology.

FIG. 15 shows an example in which the scan rate of the array of LEDs 312 is maintained above a threshold that is based on the rate of LCD scan 1402 and a number of the different groups. In the example of FIG. 15, the backlight scan rate is equal to n*RR, where n is the number of groups 406 and RR is the maximum refresh rate of LCD unit 204. As shown, in this arrangement, all of backlight row operation indicators 1404 coincide with an LCD scan 1402, even with concurrent operation of rows in different groups 406. More generally, higher backlight scan rates can be applied. For example, for a 120 Hz LCD scan rate, and a backlight with four groups 406 of rows 404 of LEDs 312, the backlight scan rate may be maintained at or above 480 Hz.

Figure 16:
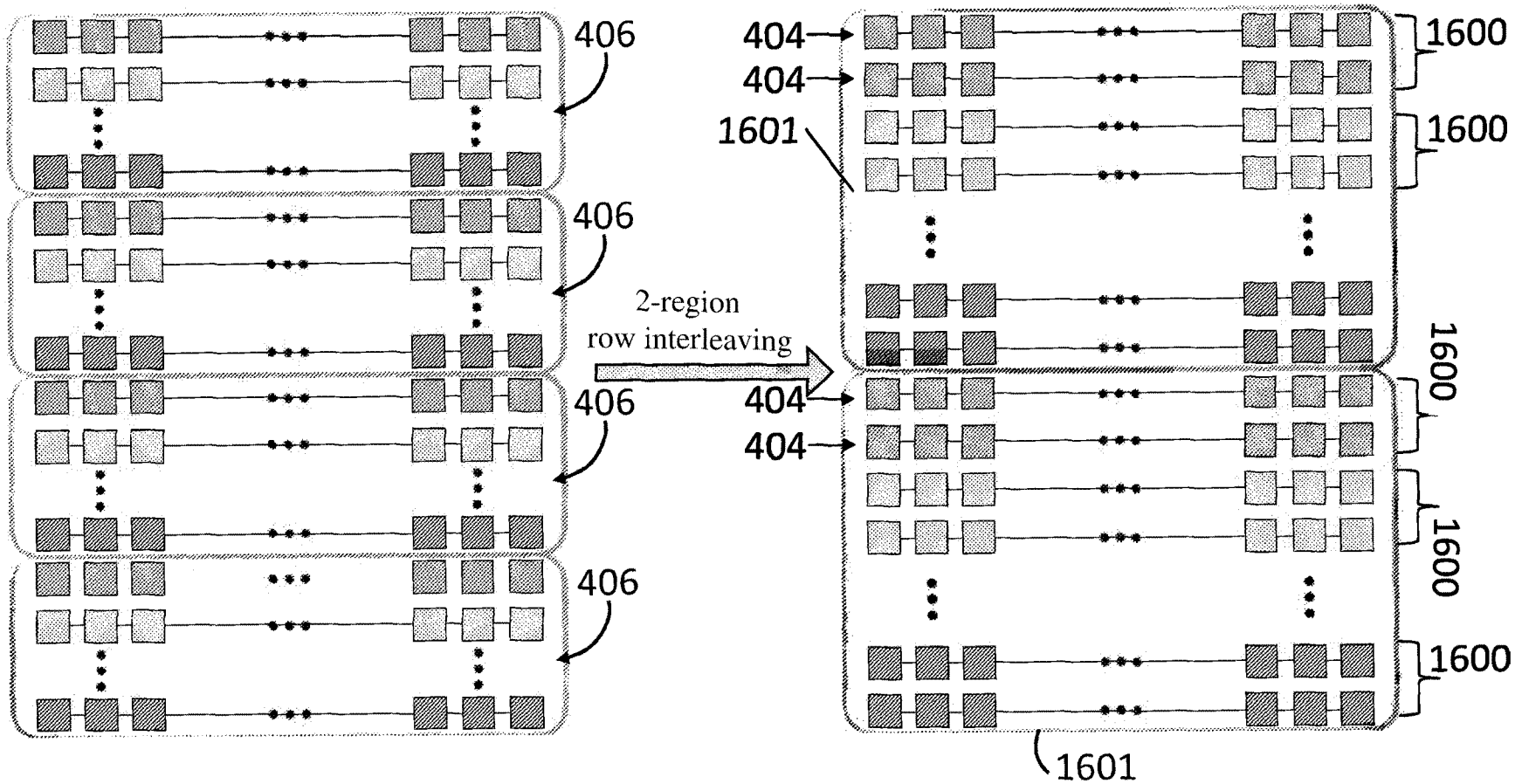
FIG. 16 illustrates a row-interleaved group-based operation of rows of LEDs of a display backlight in accordance with various aspects of the subject technology.

In some circumstances, it may be desirable to use lower scan rates than n*RR, while maintaining synchronization with LCD unit 204 (e.g., for reduced data transfer rates). FIG. 16 illustrates an example in which a relatively lower backlight scan rate can be used by concurrently operating multiple sub-groups of adjacent rows, each sub-group disposed in a different one of multiple corresponding groups of rows (e.g., by interleaving operation of the rows of groups 406).

In the example of FIG. 16, multiple sub-groups 1600 (e.g., pairs) of adjacent rows 404, each sub-group 1600 disposed in a different group 1601 of rows 404, are concurrently operated. That is, in this example, the first pair of rows in all groups 1601 is operated at the same time, the second pair of rows in all groups 1600 is operated at the same time, etc. In this way, the backlight scan rate can be reduced by a factor h corresponding to the number of rows in each sub-group 1600. It should also be appreciated that groups 1600 can include more than two rows (e.g., three rows, four rows, or more than four rows).

Figure 17:
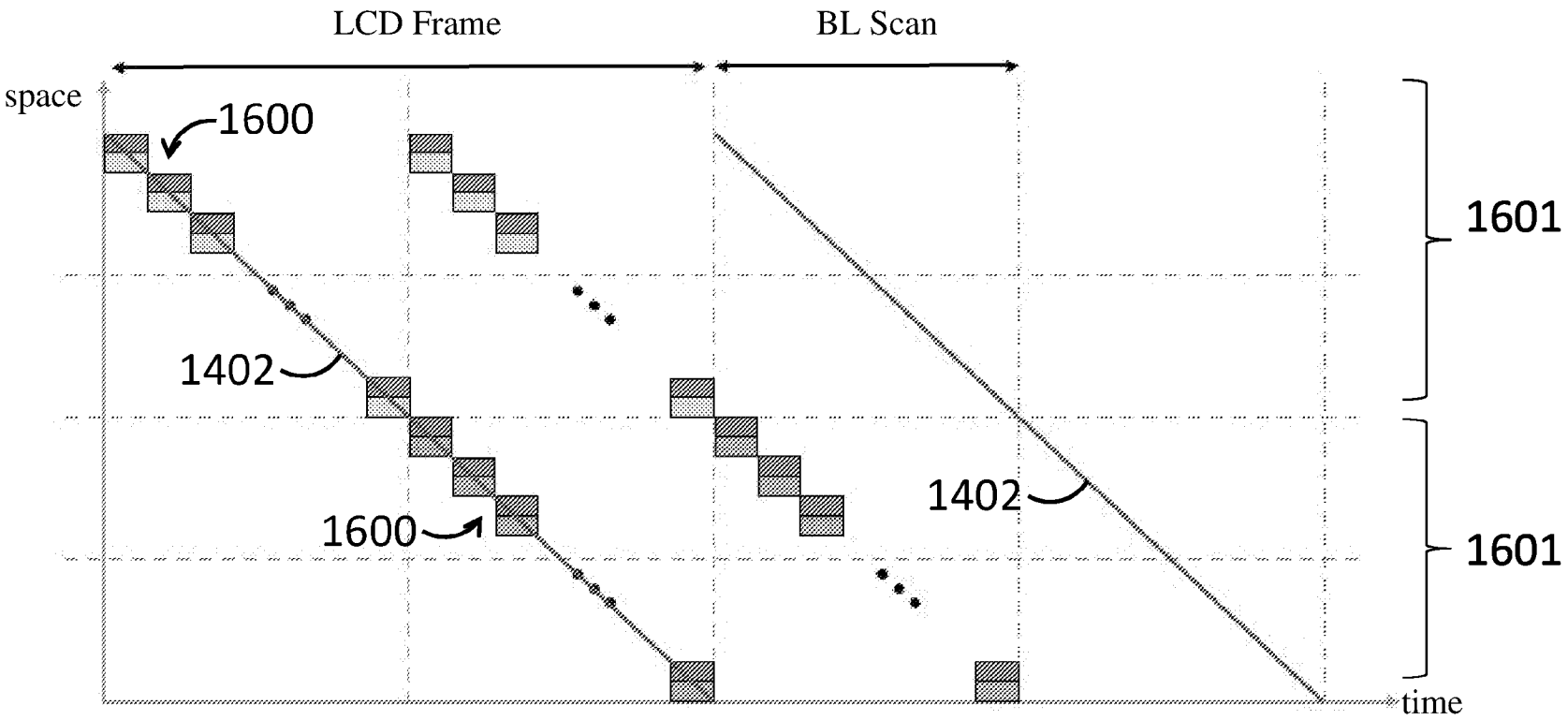
FIG. 17 illustrates an LCD synchronized operation of rows of LEDs of a display backlight based on a row-interleaved group-based operation of rows of LEDs in accordance with various aspects of the subject technology.

FIG. 17 illustrates how a backlight scan rate that is half that of the backlight scan rate illustrated in FIG. 15 can be used when sub-groups 1600 in each group 1601 are operated concurrently, while maintaining synchronization with LCD scan 1400. In the example of FIGS. 16 and 17, the rows that are connected to the same switch include sub-groups (e.g., pairs) in each group 1601. In this arrangement, the backlight scan rate may be maintained at or above n/h*RR, where n is the number of groups 406, h is the number of rows in each sub-group 1600, and RR is the maximum refresh rate of LCD unit 204.

Figure 18:
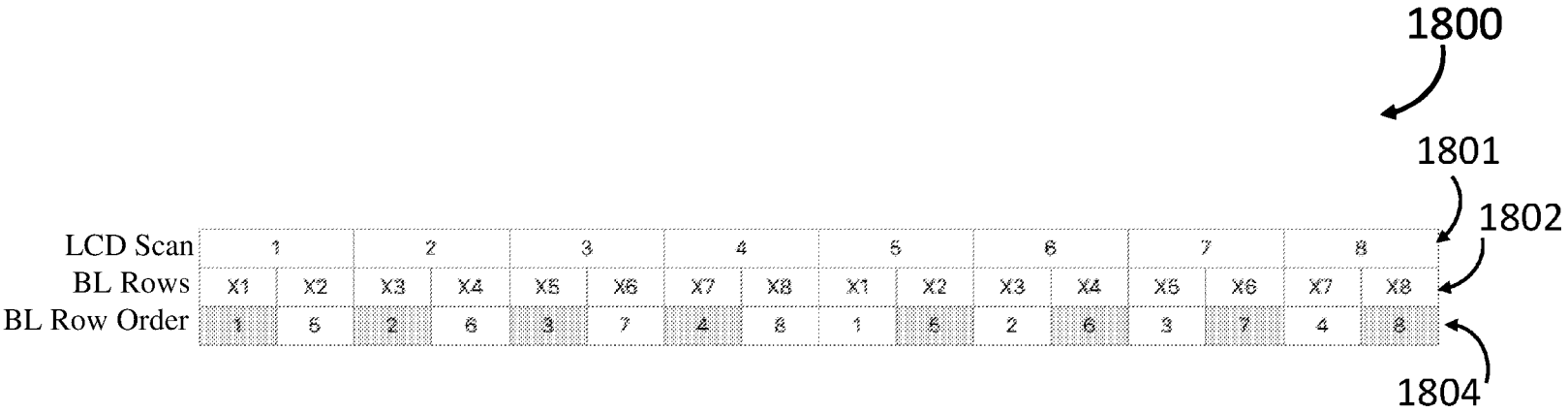
FIG. 18 shows a table illustrating row-reordering operations for LCD synchronized operation of rows of LEDs of a display backlight in accordance with various aspects of the subject technology.

As noted above, synchronization between LCD unit 204 and backlight unit 202 can also, or alternatively, be achieved by operating the rows within each of multiple corresponding groups in a non-sequential order. FIG. 18 is a table 1800 of illustrative row ordering for operation of backlight LED rows 404 for synchronization with LCD scan 1400.

In the example of FIG. 18, a row of backlight execution times 1802 (including row execution times X1, X2 . . . X8) is aligned with a row of LCD scan times 1801 and a row of backlight row numbers 1804, each corresponding to a row 404 in a group 406. In this example, the first row in each group (row 1) is executed first (e.g., illuminated during row execution time X1), the fifth row (row 5) in each group is executed second (e.g., illuminated during row execution time X2), the second row (row 2) in each group is executed third (e.g., illuminated during row execution time X3), and so forth as indicated in the table. In can be seen in table 1800 that, although the backlight scan rate is faster (e.g., twice as fast) than the LCD scan rate, the backlight execution times 1802 are vertically aligned with the LCD scan times and the backlight row order is resultantly selected such that the backlight row operation is synchronized with the LCD operations in this example.

Figure 19:
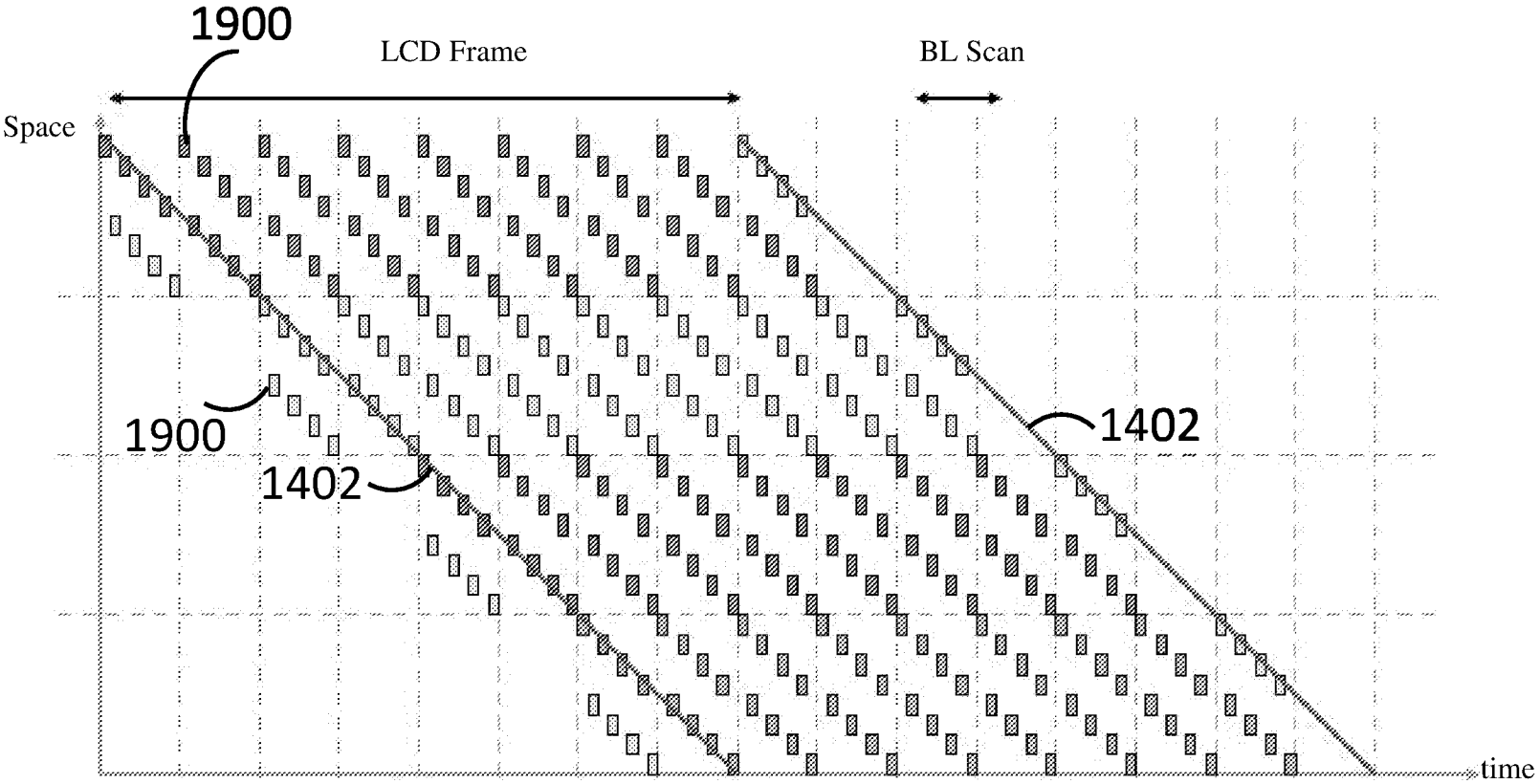
FIG. 19 illustrates an LCD synchronized operation of rows of LEDs of a display backlight based on row-reordering operations in accordance with various aspects of the subject technology.

Execution of rows 404 of groups 406 as indicated in table 1800 is illustrated in FIG. 19. As can be seen in FIG. 19, each LCD scan 1402 coincides with backlight row operation indicators 1900 for some rows during a non-sequential operation of the rows in each group 406. It should be appreciated that the row ordering indicated in table 1800 is merely illustrative and other non-sequential row orders can be executed, and more or less than eight rows per group 406 can result in different non-sequential row orderings for LCD synchronization. In these examples, the backlight scan rate may be set to a rate that is evenly divisible by n*the LCD scan rate, where n is the number of groups 406.

In accordance with various aspects of the subject disclosure, an electronic device is provided that includes a display with a backlight unit. The backlight unit includes a backlight substrate, an array of light-emitting diodes arranged in rows and columns on the backlight substrate, a backlight timing controller integrated circuit on the backlight substrate and configured to receive backlight data from host circuitry for the electronic device via a high speed link, a backlight row driver integrated circuit on the backlight substrate, where the backlight row driver integrated circuit configured to connect a high voltage power rail to the light-emitting diodes via plurality of switches, and a plurality of backlight column driver integrated circuits on the backlight substrate, each column driver integrated circuit configured to control a current through at least one of the light-emitting diodes.

In accordance with other aspects of the subject disclosure, an electronic device is provided that includes a display with a backlight unit. The backlight unit includes an array of light-emitting diodes arranged in rows and columns, the rows arranged in groups of adjacent rows, a backlight row driver, the backlight row driver having a plurality of switches, each coupled to at least one row in each of the groups of adjacent rows, and a plurality of backlight column drivers, each backlight column driver coupled to one of the groups of adjacent rows.

In accordance with other aspects of the subject disclosure, an electronic device is provided that includes a display with a backlight unit. The backlight unit includes an array of light-emitting diodes arranged in rows and columns, the rows arranged in groups of adjacent rows, a backlight row driver, the backlight row driver having a plurality of switches, each coupled to at least one row in each of the groups of adjacent rows, a plurality of backlight column drivers, each backlight column driver coupled to a subset of the columns in each of the groups of adjacent rows In accordance with other aspects of the subject disclosure, an electronic device is provided that includes a display having a liquid crystal display unit having an array of pixels configured to be operated by liquid crystal display control circuitry at an LCD scan rate, and a backlight unit. The backlight unit includes an array of light-emitting diodes arranged in rows and columns and each operable to illuminate a corresponding portion of the array of pixels. The backlight unit also includes backlight control circuitry configured to concurrently operate multiple rows of the array of light-emitting diodes, each of the multiple rows disposed in a different one of multiple corresponding groups of mutually adjacent rows. The backlight control circuitry is further configured to synchronize operation of the rows of the array of light-emitting diodes with operation of the rows of the array of pixels of the liquid crystal display unit by performing at least one of: (i) maintaining a scan rate of the array of light-emitting diodes above a threshold that is based on the LCD scan rate and a number of the different groups, (ii) concurrently operating the multiple rows by concurrently operating multiple sub-groups of adjacent rows, each sub-group disposed in a different one of the multiple corresponding groups, or (iii) operating the rows within each of the multiple corresponding groups in a non-sequential order.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device, comprising:

a display with a backlight unit, the backlight unit comprising:

a backlight substrate;

an array of light-emitting diodes arranged in rows and columns on the backlight substrate;

a backlight timing controller integrated circuit on the backlight substrate and configured to receive backlight data from host circuitry for the electronic device via a high speed link;

a backlight row driver integrated circuit on the backlight substrate, wherein the backlight row driver integrated circuit is separate from the backlight timing controller integrated circuit and coupled to the backlight timing controller integrated circuit with a dedicated data link, the backlight row driver integrated circuit configured to connect a high voltage power rail to the light-emitting diodes via plurality of switches; and a plurality of backlight column driver integrated circuits on the backlight substrate, each column driver integrated circuit configured to control a current through at least one of the light-emitting diodes and a dedicated data link between each backlight column driver integrated circuit and the backlight timing controller integrated circuit.

2. The electronic device of claim 1, wherein each backlight column driver integrated circuit is configured to provide individual pulse-width-modulation dimming or pulse-amplitude-modulation dimming for the at least one of the light-emitting diodes.

3. The electronic device of claim 1, wherein the backlight timing controller integrated circuit includes frame memory configured to store frame data for a self-refresh operation of the array of light-emitting diodes.

4. The electronic device of claim 1, wherein the backlight unit further comprises a dedicated data link between each backlight row driver integrated circuit and the backlight timing controller integrated circuit and the dedicated data link between each backlight column driver integrated circuit and the backlight timing controller integrated circuit to reduce data transfer bandwidth usage.

5. The electronic device of claim 1, further comprising host circuitry disposed on a main logic board.

6. The electronic device of claim 5, further comprising a power supply for the backlight unit on the main logic board.

7. The electronic device of claim 1, further comprising a liquid crystal display unit comprising:

an array of pixels configured to be backlit by the array of light-emitting diodes; and a timing controller configured to operate row drivers and column drivers for the array of pixels.

8. The electronic device of claim 1, wherein the array of light-emitting diodes comprises an array of strings of light-emitting diodes arranged in the rows and columns.

9. An electronic device, comprising:

a display with a backlight unit, the backlight unit comprising:

an array of light-emitting diodes arranged in rows and columns, the rows arranged in groups of adjacent rows;

a backlight row driver integrated circuit, the backlight row driver integrated circuit having a plurality of switches, each switch coupled to at least one row in each of the groups of adjacent rows; and a plurality of backlight column drivers, each backlight column driver coupled to a different group of adjacent rows.

10. The electronic device of claim 9, wherein each backlight column driver includes one channel for each column of the light-emitting diodes in one of the groups of adjacent rows.

11. The electronic device of claim 10, wherein all of the light-emitting diodes in each column of the light-emitting diodes are shorted together within each group of adjacent rows.

12. The electronic device of claim 9, wherein the backlight unit further comprises a backlight timing controller configured to generate signals that cause the backlight row driver integrated circuit and the plurality of backlight column drivers to concurrently operate at least one row in each group of adjacent rows.

13. The electronic device of claim 12, wherein the backlight timing controller is configured to generate the signals to cause the backlight row driver integrated circuit and the plurality of backlight column drivers to sequentially operate the rows in each group of adjacent rows.

14. An electronic device, comprising:

a display with a backlight unit, the backlight unit comprising:

an array of light-emitting diodes arranged in rows and columns, the rows arranged in groups of adjacent rows;

a backlight row driver integrated circuit, the backlight row driver integrated circuit having a plurality of switches, each switch coupled to at least one row in each of the groups of adjacent rows; and a plurality of backlight column drivers, each backlight column driver coupled to a different subset of the columns in each of the groups of adjacent rows.

15. The electronic device of claim 14, wherein all of the light-emitting diodes in each column of the light-emitting diodes are shorted together within each group of adjacent rows.

16. The electronic device of claim 14, wherein the backlight unit further comprises a backlight timing controller configured to generate signals that cause the backlight row driver integrated circuit and the plurality of backlight column drivers to concurrently operate at least one row in each group of adjacent rows.

17. The electronic device of claim 16, wherein the backlight timing controller is configured to generate the signals to cause the backlight row driver integrated circuit and the plurality of backlight column drivers to sequentially operate the rows in each group of adjacent rows.

18. An electronic device, comprising:

a display having:

a liquid crystal display unit having an array of pixels configured to be operated by liquid crystal display control circuitry at an LCD scan rate; and a backlight unit, the backlight unit comprising:

an array of light-emitting diodes arranged in rows and columns and each operable to illuminate a corresponding portion of the array of pixels; and backlight control circuitry configured to concurrently operate multiple rows of the array of light-emitting diodes, each of the multiple rows disposed in a different one of multiple corresponding groups of mutually adjacent rows, wherein the backlight control circuitry is further configured to synchronize operation of the rows of the array of light-emitting diodes with operation of the rows of the array of pixels of the liquid crystal display unit by performing at least one of:

(i) maintaining a scan rate of the array of light-emitting diodes of the backlight unit above a threshold that is based on the LCD scan rate and a number of the different groups, (ii) concurrently operating the multiple rows by concurrently operating multiple sub-groups of adjacent rows by interleaving a first sub-group of adjacent rows at a first time and a second sub-group of adjacent rows at a second time, each of the first sub-group disposed in a different one of the multiple corresponding groups, or (iii) operating the rows within each of the multiple corresponding groups in a non-sequential order.

19. The electronic device of claim 18, wherein the backlight control circuitry is configured to synchronize the operation of the rows of the array of light-emitting diodes of the backlight unit with the operation of the rows of the array of pixels of the liquid crystal display unit by maintaining the scan rate of the array of light-emitting diodes above the threshold that is based on the LCD scan rate and the number of the different groups, wherein the scan rate of the light-emitting diodes of the backlight unit is equal to the LCD scan rate multiplied by the number of the different groups.

20. The electronic device of claim 18, wherein the backlight control circuitry is configured to synchronize the operation of the rows of the array of light-emitting diodes with the operation of the rows of the array of pixels of the liquid crystal display unit by concurrently operating multiple sub-groups of adjacent rows, each sub-group disposed in a different one of the multiple corresponding groups, wherein each sub-group in each of the multiple corresponding groups comprises a pair of adjacent rows in that corresponding group.

21. The electronic device of claim 18, wherein the backlight control circuitry is configured to synchronize the operation of the rows of the array of light-emitting diodes with the operation of the rows of the array of pixels of the liquid crystal display unit by operating the rows within each of the multiple corresponding groups in the non-sequential order, and wherein the non-sequential order for each of the multiple corresponding groups is the same as the non-sequential order for all of the other corresponding groups.

* * * * *